US008574713B2

(12) United States Patent
Rutledge et al.

(10) Patent No.: US 8,574,713 B2
(45) Date of Patent: Nov. 5, 2013

(54) SUPERHYDROPHOBIC FIBERS AND METHODS OF PREPARATION AND USE THEREOF

(75) Inventors: Gregory C. Rutledge, W. Newton, MA (US); Randal M. Hill, Cambridge, MA (US); Joseph L Lowery, Cambridge, MA (US); Minglin Ma, Cambridge, MA (US); Sergey Fridrikh, Acton, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 791 days.

(21) Appl. No.: 11/371,223

(22) Filed: Mar. 9, 2006

(65) Prior Publication Data

US 2006/0292369 A1 Dec. 28, 2006

Related U.S. Application Data

(60) Provisional application No. 60/659,907, filed on Mar. 10, 2005.

(51) Int. Cl.

| | |
|---|---|
| ***D02G 3/00*** | (2006.01) |
| ***D04H 1/00*** | (2006.01) |
| ***B32B 19/00*** | (2006.01) |
| ***B32B 5/02*** | (2006.01) |
| ***B32B 27/04*** | (2006.01) |

(52) U.S. Cl.

USPC ..... 428/364; 428/292.1; 428/323; 428/357; 428/375; 428/394; 442/79; 442/80; 442/86; 442/88

(58) Field of Classification Search

USPC ..... 428/375, 292.1, 394, 364; 524/120, 524/147, 151, 153; 442/79, 80, 86, 88; 526/348.1, 347.2; 528/66, 44, 28, 25, 528/10, 34, 30; 264/288.4, 290.2, 341, 103; 210/500.21, 188; 525/100

See application file for complete search history.

(56) References Cited

U.S. PATENT DOCUMENTS

| | | | | | |
|---|---|---|---|---|---|
| 3,354,022 | A | * | 11/1967 | Johnson, Jr. et al. | 428/167 |
| 3,686,355 | A | * | 8/1972 | Gaines et al. | 264/341 |
| 4,861,830 | A | * | 8/1989 | Ward, Jr. | 525/92 A |
| 4,920,168 | A | * | 4/1990 | Nohr et al. | 524/188 |
| 5,589,563 | A | * | 12/1996 | Ward et al. | 528/44 |

(Continued)

FOREIGN PATENT DOCUMENTS

| | | |
|---|---|---|
| CN | 1397668 | 2/2003 |
| EP | 1449642 | 8/2004 |
| WO | WO 2005/021843 | 3/2005 |

OTHER PUBLICATIONS

Frenot et al. Polymer nanofibers assembled by electrospinning. Current Opinion in Colloid and Interface Science, 8, (2003), pp. 64-75.*

(Continued)

*Primary Examiner* — Elizabeth Cole
*Assistant Examiner* — Altrev Sykes
(74) *Attorney, Agent, or Firm* — Mark S. Cohen; Pearl Cohen Zedek Latzer Baratz LLP

(57) ABSTRACT

The present invention relates to fibers exhibiting a water contact angle of above 150° and water contact angle hysteresis of below 15°, methods of producing the same, and applications thereof. The present invention further relates to superhydrophobic fiber mats, methods of producing the same, and applications thereof.

74 Claims, 8 Drawing Sheets

(56) References Cited

U.S. PATENT DOCUMENTS

| | | | | |
|---|---|---|---|---|
| 5,641,835 | A * | 6/1997 | Smith et al. | 525/102 |
| 5,733,657 | A * | 3/1998 | Macheras et al. | 428/398 |
| 5,856,245 | A * | 1/1999 | Caldwell et al. | 442/76 |
| 5,856,416 | A | 1/1999 | Bachmann et al. | |
| 5,954,966 | A | 9/1999 | Matsuura et al. | |
| 6,127,507 | A | 10/2000 | Santerre et al. | |
| 6,664,306 | B2 | 12/2003 | Gaddam et al. | |
| 2002/0151634 | A1 * | 10/2002 | Rohrbaugh et al. | 524/430 |
| 2002/0170690 | A1 * | 11/2002 | Buchsel et al. | 162/109 |
| 2003/0080049 | A1 | 5/2003 | Lee et al. | |
| 2004/0052957 | A1 | 3/2004 | Cramer et al. | |
| 2004/0138083 | A1 | 7/2004 | Kimbrell et al. | |
| 2004/0176556 | A1 | 9/2004 | Bowers et al. | |
| 2004/0266302 | A1 * | 12/2004 | DiSalvo et al. | 442/382 |
| 2005/0008876 | A1 | 1/2005 | Teranishi et al. | |
| 2005/0053782 | A1 * | 3/2005 | Sen et al. | 428/364 |
| 2005/0148264 | A1 * | 7/2005 | Varona et al. | 442/382 |

OTHER PUBLICATIONS

Gibson, P., H. Schreuder-Gibson, and D. Rivin, Transport properties o.fporous membranes based on electrospun nanojibers. Colloids and Surfaces A, 2001. 187: p. 469-481.

Schreuder-Gibson, H, P. Gibson, K. Senecl, M, Sennett, J. Walker, W. Yeomana, O, Ziegler, and F, P. Tsai, Protective textile materials based on electrospun nanofibers. Journal of Advanced Materials, 2002. 34(3): p. 44-55.

Schreuder-Gibson, Hi.. Q. Truong, J.E. Walker, J,R, Owens, J.D, Wander, and W.E, Jones. Chemical and biological protection and detection in fabrics for protective clothing. MRS Bulletin, 2003 2R(8): p. 574-578.

Li. D. and Y,N, Xia. Electrospinning of nanofibers: Reinventing the wheel? Advanced Materials, 2004. 16(1): p. 1151-1170.

Frenot, A. and I.S, Chronakis, Polymer nanefibers assembled by electrospzfl fling. Current Opinion in Colloid & Interface Science, 2003. 8(1): p. 64-75.

Deitzel, J.M., 'jAY, Kosik, Se, McKnight, N,C,B. Tan, J,M. DeSimone, and S. Crette, Eiectrospinnin.g ofpolymer nanofibers with specific surface chemistry. Polymer, 2002. 43(3): p. 1025-1029.

Gibson, P. and H. Schreuder-Gibson, Patterned electrosprav fiber structures. International Nonwovens Technical Conference, Sep. 15-18, 2003: p. 1.

Miwa. M.. A. Nakajirna. A. Fujishima, K. Hashimoto. and T. Watanabe, Effects of the Surface Roughness on Sliding Angles of Water Droplets on Superhydrophobie Surfaces. Lannuir, 2000. 16: p. 5754-5760.

Slang, L., V. Zflao, and J, Thai, A lotus-leaf like superhydrophobic surface: A porous inicrosphere/nanofiber composite fl/rn prepared by elecirohydrodynamics, Aflgewandto Chenhie_Intensational Edition. 2004.43(33): p. 4338-4=41.

Feng, U, S.H. Li, H.J. Li, J. Zhai. V,L, Song, L. Jiang, and D,B. Zhu, Super-hydrophobic surface ofal&gnedpolyaciy/onitrile nanofibers. Angewandte Chemie-International Edition. 2002, 41(7): p. 1221-.

Supplementary European Search Report for EP 06737690, Aug. 5, 2009.

* cited by examiner (a) (b)

SUPERHYDROPHOBIC FIBERS AND METHODS OF PREPARATION AND USE THEREOF

CROSS-REFERENCE TO RELATED APPLICATIONS

This Application claims the benefit of U.S. Provisional Application Ser. No. 60/659,907, filed Mar. 10, 2005, which is hereby incorporated by reference in its entirety.

GOVERNMENT INTEREST STATEMENT

This invention was made with government support awarded by the Army Research Office under ARO Grant No. DAAD19-02-D-0002. The government has certain rights in this invention.

FIELD OF THE INVENTION

The present invention relates to fibers exhibiting a water contact angle of above 150° and water contact angle hysteresis of below 15°, methods of producing the same, and applications thereof. The present invention further relates to superhydrophobic fiber mats, methods of producing the same, and applications thereof.

BACKGROUND OF THE INVENTION

Electrospinning is a versatile method to produce polymer fibers with diameters in the micron, sub-micron and nano (<100 nm) range. Numerous polymeric materials have been electrospun into continuous, uniform fibers, and various applications of the fibers have been widely recognized. The method employs electrostatic forces to stretch a polymer jet and make superfine fibers. Electrohydrodynamic instabilities that occur in electrospinning, charge density of the electrified jet (and indirectly, solution conductivity), surface tension, and viscoelasticity of the solution have been shown to play important roles both in making the production of fibers possible and in controlling the size and uniformity of the fibers. The development of internal structure in such fibers has generally been limited to crystallization of homopolymer or macrophase separation of a polymer blend during the drying and solidification of the fiber, inclusion of immiscible additives such as clays, nanotubes and metallic or oxide particles. Surface structures attributed to "breath figures" have also been shown.

Block copolymers offer an alternative method by which internal structure can be induced in electrospun fibers via microphase separation. In bulk, block copolymers are known to form microphase separated structures such as spheres, cylinders, gyroids and lamellae, depending on molecular weight, volume fractions of components and the degree of immiscibility of the different polymer blocks. In thin films, it has been shown that surface forces and confinement effects are strong enough to alter the phase separation behavior. However, no such information is currently available on microphase separation in a confined cylindrical, sub-micrometer sized and fiber-like geometry. Electrospinning of block copolymers is therefore not only promising for applications involving surface chemistry, drug delivery and multifunctional textiles, but is also of intrinsic scientific interest.

The wetting behavior of a solid surface is important for various commercial applications and depends strongly on both the surface energy or chemistry and the surface roughness. Currently, surfaces with a water contact angle above 150° are considered to be "superhydrophobic" and are the subject of great interest for their water proof and self-cleaning usages. There is a need to develope fiber-forming processes and products that would demonstrate the desired surface characteristics, such as superhydrophobicity, as well as other properties, such as mechanical strength and integrity.

SUMMARY OF INVENTION

In one embodiment, this invention provides a fiber comprising a copolymer wherein said fiber exhibits a water contact angle of above 150° and water contact angle hysteresis of below 15°.

In one embodiment, this invention provides a superhydrophobic fiber mat, wherein said mat comprises fibers comprising a copolymer and wherein said mat exhibits a water contact angle of above 150° and water contact angle hysteresis of below 15°.

In one embodiment, this invention provides a method for preparing a superhydrophobic fiber or fibers, the method comprising the step of electrospinning a solution comprising a copolymer, wherein said copolymer comprises a component, comprising a silicon structure and having a surface energy of less than 1 $mJ/m^2$, said solution exhibits conductivity, surface tension and viscoelasticity fluidic properties, and whereby said electrospinning produces a superhydrophobic fiber or fibers exhibiting a water contact angle of above 150° and water contact angle hysteresis of below 15°.

In one embodiment, the method further comprises the step of producing a superhydrophobic mat comprising said fibers.

In one embodiment, this invention provides a composition comprising a fiber of this invention.

In one embodiment, the invention provides an article of manufacture comprising a fiber or mat of this invention.

DETAILED DESCRIPTION OF THE INVENTION

Figure 1:
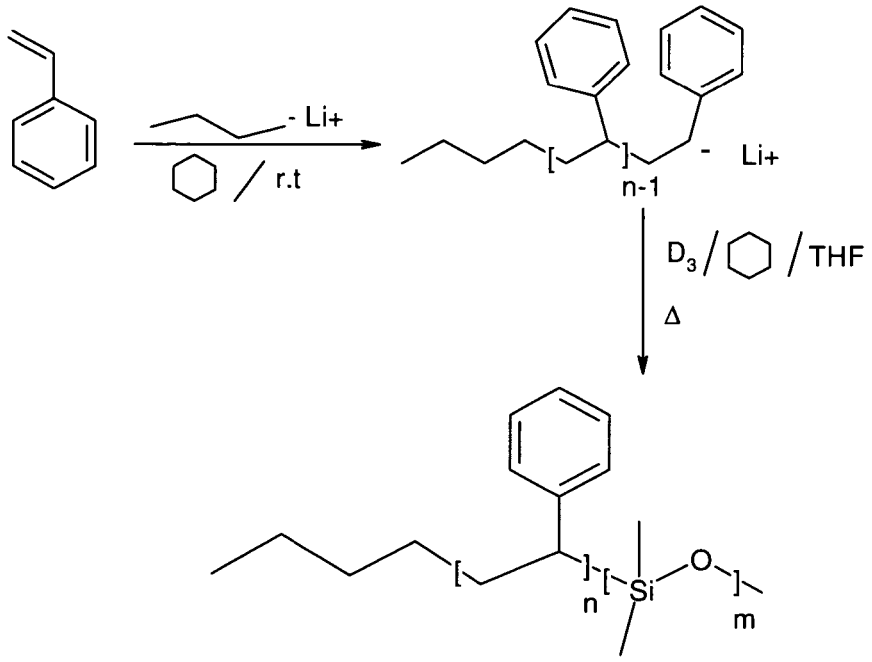
FIG. 1 demonstrates a reaction scheme for synthesis of PS-PDMS, according to embodiments of the invention.

In one embodiment, this invention provides a fiber comprising a copolymer wherein said fiber exhibits a water contact angle of above 150° and water contact angle hysteresis of below 15°.

In one embodiment, this invention provides a superhydrophobic fiber mat, wherein said fiber comprises a copolymer and wherein said mat exhibits a water contact angle of above 150° and water contact angle hysteresis of below 15°.

In one embodiment of this invention, the water contact angle may be above 160°. In another embodiment, the water contact angle may be about 163°. In another embodiment, the water contact angle may be between 160°-165°. In another embodiment, the water contact angle may be between 150°-160°. In another embodiment, the water contact angle may be between 160°-165°. In another embodiment, the water contact angle may be between 160°-170°. In another embodiment, the water contact angle may be between 160°-175°.

In one embodiment of this invention, the water contact angle hysteresis may be between 10°-15°. In another embodiment, the water contact angle hysteresis may be between 10°-14°. In another embodiment, the water contact angle hysteresis may be between 8°-13°. In another embodiment, the water contact angle hysteresis may be between 6°-12°. In another embodiment, the water contact angle hysteresis may be between 5°-10°. In another embodiment, the water contact angle hysteresis may be between 0°-5°.

In one embodiment of this invention, the fiber may exhibit surface roughness properties.

In one embodiment of this invention, the mat may be electrospun. In another embodiment, the mat may exhibit wettability properties. In another embodiment, the mat may be composed solely of fibers. In another embodiment, the fibers within the mat are uniform. In another embodiment, the mat may be composed solely of fibers randomly oriented within a plane. In one embodiment of this invention, the mat may exhibit a water contact angle of above 160°. In another embodiment, the mat may exhibit a water contact angle of about 163°. In another embodiment, the mat may exhibit a water contact angle of between 160°-165°. In another embodiment, the mat may exhibit a water contact angle of between 150°-160°. In another embodiment, the mat may exhibit a water contact angle of between 160°-165°. In another embodiment, the mat may exhibit a water contact angle of between 160°-170°. In another embodiment, the mat may exhibit a water contact angle of between 160°-175°.

In one embodiment of this invention, the mat may exhibit a water contact angle hysteresis of between 10°-15°. In another embodiment the mat may exhibit a water contact angle hysteresis of between 10°-14°. In another embodiment, the mat may exhibit a water contact angle hysteresis of between 8°-13°. In another embodiment, the mat may exhibit a water contact angle hysteresis of between 6°-12°. In another embodiment, the mat may exhibit a water contact angle hysteresis of between 5°-10°. In another embodiment, the mat may exhibit a water contact angle hysteresis of between 0°-5°.

In one embodiment of this invention, the mat may exhibit an isotropic nature of the contact angle, contact angle hysteresis or a combination thereof.

In one embodiment of this invention, the mat may exhibit a non-isotropic nature of the contact angle, contact angle hysteresis or a combination thereof.

In one embodiment of this invention, the mat may include:

- domains exhibiting an isotropic nature of the contact angle, contact angle hysteresis or a combination thereof,
- domains exhibiting a non-isotropic nature of the contact angle, contact angle hysteresis or a combination thereof, or a combination thereof.

In one embodiment of this invention, the mat may exhibit surface roughness properties.

In one embodiment of this invention, the mat may exhibit pore sizes of between 0.01-100 micron. In another embodiment, the mat may exhibit pore sizes of between 0.1-100 micron. In another embodiment, the mat may exhibit pore sizes of between 0.1-50 micron. In another embodiment, the mat may exhibit pore sizes of between 0.1-10 micron. In another embodiment, the mat may exhibit pore sizes of between 0.1-5 micron. In another embodiment, the mat may exhibit pore sizes of between 0.1-2 micron. In another embodiment, the mat may exhibit pore sizes of between 0.2-1.5 micron. In another embodiment, the pore size may be non-uniform. In another embodiment, the pore size may be uniform.

In one embodiment of this invention, the diameter of the fiber, or, in another embodiment, fibers in the mat, which in some comprise only some fibers, or in other embodiments comprises fibers mostly having a diameter of between 1 nm-5 micron, or in another embodiment, the diameter is between 1 nm-500 nm, or in another embodiment, the diameter is between 1 nm-100 nm, or in another embodiment, the diameter is between 100 nm-300 nm, or in another embodiment, the diameter is between 100 nm-500 nm, or in another embodiment, the diameter is between 50 nm-400 nm, or in another embodiment, the diameter is between 200 nm-500 nm, or in another embodiment, the diameter is between 300 nm-600 nm, or in another embodiment, the diameter is between 400 nm-700 nm, or in another embodiment, the diameter is between 500 nm-800 nm, or in another embodiment, the diameter is between 500 nm-1000 nm, or in another embodiment, the diameter is between 1000 nm-1500 nm, or in another embodiment, the diameter is between 1500 nm-3000 nm, or in another embodiment, the diameter is between 2000 nm-5000 nm, or in another embodiment, the diameter is between 3000 nm-4000 nm.

In one embodiment of this invention, the fiber may be an electrospun fiber.

In one embodiment of this invention, the fiber may exhibit a microphase-separation.

In one embodiment of this invention, the fiber may include, inter alia, a component, wherein the surface energy of the component is below 5 $mJ/m^2$. In one embodiment of this invention, the fiber may include, inter alia, a component, wherein the surface energy of the component is below 1 $mJ/m^2$. In another embodiment, the surface energy of the component is between 0.1-1 $mJ/m^2$. In another embodiment, the surface energy of the component is between 0.1-0.5 $mJ/m^2$. In another embodiment, the surface energy of the component is between 0.5-0.9 $mJ/m^2$.

In one embodiment of this invention, the component may segregate to the surface of the fiber. In another embodiment, the component may be a part of the copolymer. In another embodiment, the component may include, inter alia, a silicon structure. In another embodiment, the silicon structure may be, inter alia, a resin, linear, branched, cross-linked, cross-linkable silicone structure or any combination thereof. In another embodiment, the silicon structure may include, inter alia, poly-dimethylsiloxane (PDMS). In another embodiment, the silicon structure may include, inter alia, fluorine.

In one embodiment of this invention, the copolymer may include, inter alia, polyisobutylene, polyolefin, polystyrene, polyacrylate, polyurethane, polyester, polyamide, polyetherimide, any derivative thereof or any combination thereof. In another embodiment, the copolymers according to the invention may be substituted or unsubstituted. In another embodiment, the copolymers according to the invention may be saturated or unsaturated. In another embodiment, the copolymers according to the invention may be linear or branched. In another embodiment, the copolymers according to the invention may be alkylated. In another embodiment, alkylated may be methylated. In another embodiment, the copolymers according to the invention may be halogenated. In another embodiment, the copolymers according to the invention may be chlorinated. In another embodiment, the polyolefin may include, inter alia, polyisobutylene, polyethylene, polypropylene or any combination thereof. In another embodiment, the copolymers according to the invention may be fluorinated. In another embodiment, the copolymer may include, inter alia, poly(alphamethyl)styrene.

In another embodiment, the copolymer may include, inter alia, a block, graft, star or random copolymer. In another embodiment, the block copolymer may include, inter alia, poly(styrene-co-dimethylsiloxane) (PS-PDMS), or in another embodiment, poly(dimethylsiloxane-co-etherimide).

In one embodiment of this invention, the molecular weight of the PS-PDMS may be higher than about 100K. In another embodiment, the molecular weight of the PS-PDMS may range between about 100K-5000K. In another embodiment, the molecular weight of the PS-PDMS may range between about 100K-1000K. In another embodiment, the molecular weight of the PS-PDMS may range between about 100K-500K. In another embodiment, the molecular weight of the PS-PDMS may range between about 200K-300K. In another embodiment, the molecular weight of the PS-PDMS may be higher than about 250K. In another embodiment the molecular weight of the PS-PDMS may be 150K, or about 150K. In one embodiment, the term "about" refers to a deviance from the stated value or range of values by +/−1%, or in another embodiment, by +/−2%, or in another embodiment, by +/−5%, or in another embodiment, by +/−7%, or in another embodiment, by +/−10%, or in another embodiment, by +/−13%, or in another embodiment, by +/−15%, or in another embodiment, by +/−18%, or in another embodiment, by +/−20%.

In one embodiment of this invention, the fiber may include, inter alia, poly-dimethylsiloxane (PDMS) blocks non-uniformly dispersed within a polystyrene (PS) matrix. In one embodiment of this invention, the fiber may include, inter alia, polystyrene-polydimethylsiloxane copolymer blocks non-uniformly dispersed within a siloxane matrix.

In one embodiment of this invention, the copolymer may include, inter alia, polystyrene (PS). In another embodiment, the volume fraction of PS in the copolymer may be between 0.05-0.9. In another embodiment, the volume fraction of PS in the copolymer may be between 0.1-0.6. In another embodiment, the volume fraction of PS in the copolymer may be between 0.3-0.5. In another embodiment, the volume fraction of PS in the copolymer may be between 0.4-0.9. In another embodiment, the volume fraction of PS in the copolymer may be 0.45. In another embodiment, the volume fraction of PS in the mixture may be between 0.1-0.9. In another embodiment, the volume fraction of PS in the mixture may be between 0.3-0.6. In another embodiment, the volume fraction of PS in the mixture may be 0.57. In another embodiment, the volume fraction of PS in the mixture may be 0.813. In another embodiment, the volume fraction of PS in the mixture may be 0.05-0.9, and exhibit may exhibit a cylindrical morphology upon microphase separation in the bulk.

In one embodiment of this invention, the poly-dimethylsiloxane (PDMS) blocks may segregate to the surface of the fiber.

In one embodiment of this invention, the poly-dimethylsiloxane (PDMS) blocks may be aligned along the fibers axis.

In one embodiment, this invention provides a superhydrophobic nonwoven mat including submicron diameter fibers of poly(styrene-co-dimethylsiloxane) (PS-PDMS) block copolymers blended with homopolymer polystyrene (PS). In one embodiment, the PS/PDMS system of this invention, has a larger Flory interaction parameter compared to the conventional styrene-diene block copolymers. In one embodiment, the PS/PDMS system of this invention, exhibits a pronounced surface activity of the PDMS block. In one embodiment of this invention, the Flory interaction of the PS/PDMS system and the pronounced surface activity of the PDMS block facilitate the microphase separation in the electrospun fibers even without any post treatment. In one embodiment, the superhydrophobicity of the electrospun mats according to the invention may be determined by static and dynamic contact angle attributed to both the surface roughness and surface excess of the PDMS blocks. In one embodiment, the superhydrophobicity of the electrospun mats according to the invention may be obtained without the presence of microspheres within the mat. In one embodiment, the superhydrophobicity of the electrospun mats according to the invention may exhibit an isotropic nature of the contact angle hysteresis. In another embodiment, the isotropic nature of the contact angle hysteresis may be attributed to the random in-plane arrangement of fibers, which may mitigate pinning effects on the liquid drop. In one embodiment, the high surface tension at the air/polymer interface and/or the confinement of the microphase separated structures to the fiber geometry and/or the aligning effect of the elongational flow according to the invention may have some effects on the morphologies of the block copolymers.

In one embodiment, this invention provides a method for preparing a fiber, wherein the fiber includes a copolymer and wherein the fiber exhibits a water contact angle of above 150° and water contact angle hysteresis of below 15°, the method may include, inter alia, the step of electrospinning a solution including, inter alia, the copolymer.

In one embodiment, this invention provides a method for preparing a superhydrophobic fiber mat, wherein the fiber includes a copolymer and wherein the mat exhibits a water contact angle of above 150° and water contact angle hysteresis of below 15°, the method may include, inter alia, the step of electrospinning a solution including, inter alia, the copolymer.

In one embodiment of this invention, the concentration of the poly(styrene-co-dimethylsiloxane) (PS-PDMS) in the solution is 21%. In another embodiment, the concentration of the poly(styrene-co-dimethylsiloxane) (PS-PDMS) in the solution is about 21%. In another embodiment, the concentration of the poly(styrene-co-dimethylsiloxane) (PS-PDMS) in the solution is between 5-10%. In another embodiment, the concentration of the poly(styrene-co-dimethylsiloxane) (PS-PDMS) in the solution is between 10-20%. In another embodiment, the concentration of the poly(styrene-co-dimethylsiloxane) (PS-PDMS) in the solution is between 20-25%. In another embodiment, the concentration of the poly(styrene-co-dimethylsiloxane) (PS-PDMS) in the solution is between 15-25%. In another embodiment, the concentration of the poly(styrene-co-dimethylsiloxane) (PS-PDMS)

in the solution is between 20-30%. In another embodiment, the concentration of the poly(styrene-co-dimethylsiloxane) (PS-PDMS) in the solution is between 20-40%.

In some embodiments, the polystyrene-polydimethylsiloxane copolymer is mixed with a siloxane resin such as MQ siloxane resin (Dow Corning 407), at various ratios, for example, 18:5, 15:10, 12:12 copolymer to resin, or in another embodiment, about 10-25:5-15 copolymer to resin ratio. In some embodiments, the total solids level is 25%, or in another embodiment, 23%, or in another embodiment, 24%, or in another embodiment, about 18%-30%. In one embodiment, the mixture is dissolved in 3:1 THF-DMF solvent.

In one embodiment of this invention, the solution includes a solvent. In another embodiment, the solvent is an organic solvent. In another embodiment, the solvent may include, inter alia, tetrahydrofuran, diethylformamide or a combination thereof. In another embodiment, the solvent may include, inter alia, tetrahydrofuran and diethylformamide in a ratio of 3:1. In another embodiment, the solvent may include, inter alia, chloroform, toluene or a combination thereof. In one embodiment, the solvent comprises chloroform:diethylformamide in a ratio of 4:1.

In one embodiment of this invention, the solution may include additives. In another embodiment, the additives may include, inter alia, inorganic salts, organic salts, surfactants or any combination thereof. In another embodiment, the additives may include, inter alia, any material that increases the conductivity of the solution. In another embodiment, the additives may include, inter alia, any material that decreases the surface tension of the solution. In another embodiment, the additives may include, inter alia, a dye. In another embodiment, the additives may include, inter alia, a colorant. In another embodiment, the additives may include, inter alia, a labeling agent.

In one embodiment of this invention, the solution exhibits conductivity, surface tension and viscoelasticity fluidic properties. In one embodiment of this invention, the zero shear rate viscosity of the solution may be between 0.1-10 PaS. In another embodiment, the zero shear rate viscosity of the solution may be between 0.5-10 PaS. In another embodiment, the zero shear rate viscosity of the solution may be between 1-10 PaS. In another embodiment, the zero shear rate viscosity of the solution may be between 5-8 PaS. In another embodiment, the zero shear rate viscosity of the solution may be about 6 PaS.

In one embodiment of this invention, the extensional viscosity of the solution may be between 0.1-100,000 PaS. In another embodiment, the extensional viscosity of the solution may be between 100-1000 PaS. In another embodiment, the extensional viscosity of the solution may be between 1-100 PaS. In another embodiment, the extensional viscosity of the solution may be between 5-50 PaS. In another embodiment, the extensional viscosity of the solution may be about 10 PaS.

In one embodiment of this invention, the solution conductivity may be between 0.01-25 mS/m. In another embodiment, the solution conductivity may be between 0.1-10 mS/m. In another embodiment, the solution conductivity may be between 0.1-5 mS/m. In another embodiment, the solution conductivity may be between 0.1-1 mS/m. In another embodiment, the solution conductivity may be between 0.1-0.5 mS/m. In another embodiment, the solution conductivity may be about 0.3 mS/m.

In one embodiment of this invention, the surface tension of the solution may be between 10-100 mN/m. In another embodiment, the surface tension of the solution may be between 20-80 mN/m. surface tension of the solution may be between 20-50 mN/m. In another embodiment, the surface tension of the solution may be about 30 mN/m.

In one embodiment of this invention, the dielectric constant of the solution may be between 1-100. In another embodiment, the dielectric constant of the solution may be between 5-50. In another embodiment, the dielectric constant of the solution may be between 10-70. In another embodiment, the dielectric constant of the solution may be between 1-20. In another embodiment, the dielectric constant of the solution may be about 10.

In one embodiment of this invention, the zero shear rate viscosity of the solution may be 6 Pa S, the extensional viscosity of the solution may be 10 Pa S, the solution conductivity may be 0.3 mS/m and the surface tension of the solution may be 30 mN/m.

In one embodiment of this invention, the molecular weight of the PS-PDMS may be about 240K, the concentration of the PS-PDMS in the solution may be about 21%, and the solution includes THF and DMF in a ratio of 3:1.

In one embodiment of this invention, the term "percent" or "%" may refer to weight percent.

In one embodiment of this invention, the voltage applied in the electrospinning may range between 5-50 KV. In another embodiment, the voltage applied in the electrospinning may range between 10-40 KV. In another embodiment, the voltage applied in the electrospinning may range between 15-35 KV. In another embodiment, the voltage applied in the electrospinning may range between 20-30 KV. In another embodiment, the voltage applied in the electrospinning may be about 30 KV.

In one embodiment of this invention, the distance between electrodes in the electrospinning may range between 10-100 cm. In another embodiment, the distance between electrodes in the electrospinning may range between 20-75 cm. In another embodiment, the distance between electrodes in the electrospinning may range between 30-60 cm. In another embodiment, the distance between electrodes in the electrospinning may range between 40-50 cm. In another embodiment, the distance between electrodes in the electrospinning may be about 50 cm.

In one embodiment of this invention, the flow rate in the electrospinning may range between 0.005-0.5 ml/min. In another embodiment, the flow rate in the electrospinning may range between 0.005-0.1 ml/min. the flow rate in the electrospinning may range between 0.01-0.1 ml/min. the flow rate in the electrospinning may range between 0.02-0.1 ml/min. the flow rate in the electrospinning may be about 0.05 ml/min.

In one embodiment of this invention, the electric current in the electrospinning may range between 10-10,000 nA. In another embodiment, the electric current in the electrospinning may range between 10-1000 nA. In another embodiment, the electric current in the electrospinning may range between 50-500 nA. In another embodiment, the electric current in the electrospinning may range between 75-100 nA. In another embodiment, the electric current in the electrospinning may be around 85 nA.

In one embodiment of this invention, the voltage applied in the electrospinning may be about 30 KV, the flow rate may be the electrospinning is about 0.05 mL/min and the electric current in the electrospinning may be about 85 nA.

In one embodiment of this invention, a parallel plate setup may be used in the electrospinning.

In one embodiment, electrospinning may be conducted with the aid of any suitable apparatus as will be known to one skilled in the art.

In one embodiment, the methods of this invention, may further include post treatment of the fibers. In one embodiment, the methods of this invention may further include annealing of the fibers. In another embodiment, the annealing of the fibers may enhance the hydrophobicity for these fibers. In another embodiment, the annealing of the fibers may enhance the regularity of the microphases for these fibers.

In one embodiment, this invention provides a composition including any fiber according to the invention.

In one embodiment, this invention provides an article of manufacture including any fiber according to this invention. In another embodiment, this invention provides an article of manufacture including any mat according to this invention. In another embodiment, the article of manufacture may be, inter alia, a waterproof substance. In another embodiment, the article of manufacture may be, inter alia, a water resistant substance. In another embodiment, the article of manufacture may be, inter alia, a self-cleaning substance. In another embodiment, the article of manufacture may be, inter alia, a water draining substance. In another embodiment, the article of manufacture may be, inter alia, a coating substance. In another embodiment, the coating substance reduces drag. In another embodiment, the coating substance reduces drag in a gas, in a liquid or in both. In another embodiment, the gas may be air. In another embodiment, the liquid may be water.

In another embodiment of this invention, the article of manufacture may be a membrane.

In another embodiment of this invention, the article of manufacture may be, inter alia, manufacture is a fabric. In another embodiment, the fabric may be, inter alia, a breathable fabric. In another embodiment, the fabric may have, inter alia, a filtration functionality. In another embodiment, the fabric may have, inter alia, an absorptive functionality. In another embodiment, the fabric may be, inter alia, a non-woven fabric. In another embodiment, the fabric may be, inter alia, a waterproof fabric. In another embodiment, the fabric may be, inter alia, a water resistant fabric.

In one embodiment of this invention, the fabric may be a superhydrophobic fabric. In another embodiment, the fabric may be an electrospun fibrous fabric. In one embodiment of this invention, the fabric may exhibit a water contact angle of above 160°. In another embodiment, the fabric may exhibit a water contact angle of about 163°. In another embodiment, the fabric may exhibit a water contact angle of between 160°-165°. In another embodiment, the fabric may exhibit a water contact angle of between 150°-160°. In another embodiment, the fabric may exhibit a water contact angle of between 160°-165°. In another embodiment, the fabric may exhibit a water contact angle of between 160°-170°. In another embodiment, the fabric may exhibit a water contact angle of between 160°-175°.

In one embodiment of this invention, the fabric may exhibit a water contact angle hysteresis of between 10°-15°. In another embodiment the fabric may exhibit a water contact angle hysteresis of between 10°-14°. In another embodiment, the fabric may exhibit a water contact angle hysteresis of between 8°-13°. In another embodiment, the fabric may exhibit a water contact angle hysteresis of between 6°-12°. In another embodiment, the fabric may exhibit a water contact angle hysteresis of between 5°-10°. In another embodiment, the fabric may exhibit a water contact angle hysteresis of between 0°-5°.

In another embodiment of this invention, the article of manufacture may be, inter alia, a drug delivery system. In another embodiment, the article of manufacture may be, inter alia, a bandage or patch. In another embodiment, the bandage or patch may include, inter alia, a drug.

In one embodiment of the invention, the term "contact angle" may refer to the angle on the liquid side tangential line draw through the three phase boundary where a liquid, gas and solid intersect.

In one embodiment of the invention, the term "static contact angle" may refer to the contact angle measured of a Sessile drop on a solid substance when the three phase line is not moving.

In one embodiment of the invention, the term "dynamic contact angle" may be divided into "advancing contact angle" and "receding contact angle" which may refer to, according to embodiments of the invention, to the contact angles measured when the three phase line is in controlled movement by wetting the solid by a liquid or by withdrawing the liquid over a pre-wetted solid, respectively. In another embodiment, the liquid is water.

In one embodiment of the invention, the term "contact angle hysteresis" may refer to the difference between the measured advancing and receding contact angles.

In one embodiment of the invention, the term "wettability" may refer to the process when a liquid spreads on (wets) a solid substrate. In another embodiment wettability may be estimated by determining the contact angle.

In one embodiment of the invention, the term "surface tension" may refer to the measurement of the cohesive (excess) energy present at a gas/liquid interface.

In one embodiment of the invention, the term "viscoelasticity" may refer to a combination of viscous and elastic properties in a material with the relative contribution of each being dependent on time, temperature, stress and strain rate.

In one embodiment of the invention, the terms "viscosity" or "viscous" may refer to the resistance of a material to flow under stress.

The following examples are presented in order to more fully illustrate some embodiments of the invention. They should, in no way be construed, however, as limiting the scope of the invention.

EXAMPLES

Preparation and Measurement of Electrospun Fibers

A Poly(styrene-co-dimethylsiloxane) diblock copolymer was synthesized at Dow Corning Corp. laboratories by sequential controlled anionic polymerization of styrene and then hexamethylcyclotrisiloxane ($D_3$) as shown in FIG. 1 [Rosati, D.; Perrin, M.; Navard, P.; Harabagiu, V.; Pinteala, M.; Simionescu, B. C. *Macromolecules,* 1998, 31, 4301; Pantazis, D.; Chalari, I.; Hadjichristidis, N. *Macromolecules,* 2003, 36, 3783]. All operations were carried out in a Schlenk line operating under a vacuum pump and dry nitrogen or argon.

Figure 2:
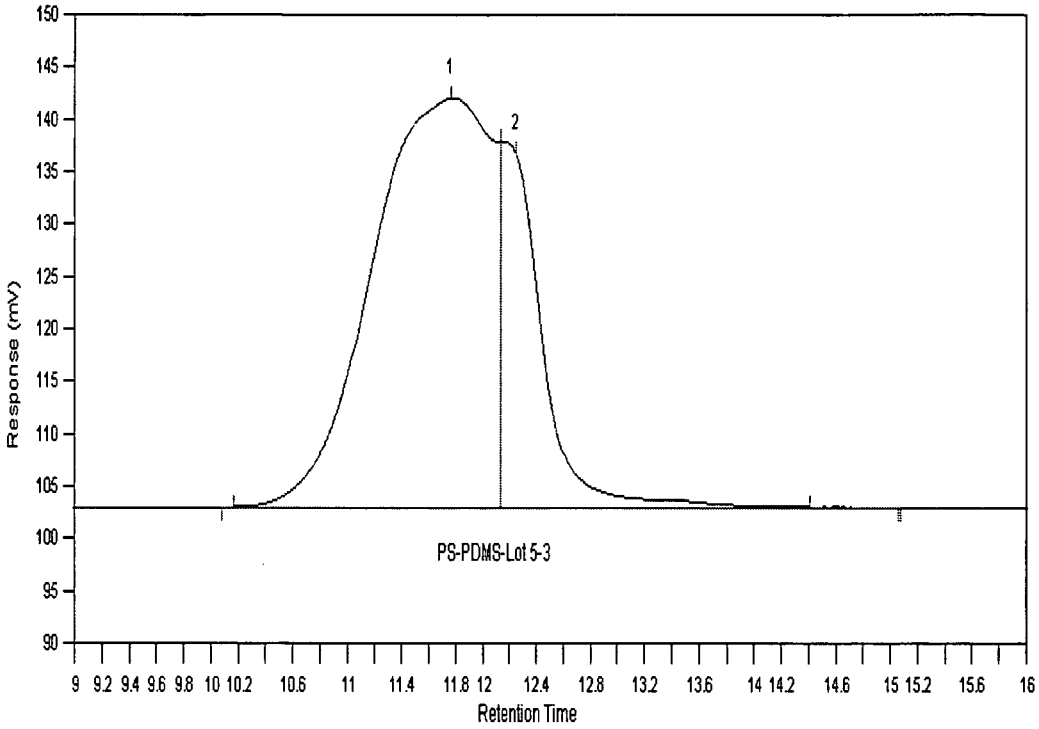
FIG. 2 demonstrates a SEC chromatogram of the PS-PDMS (solvent=THF, run against PS standards), according to embodiments of the invention.
Figure 3:
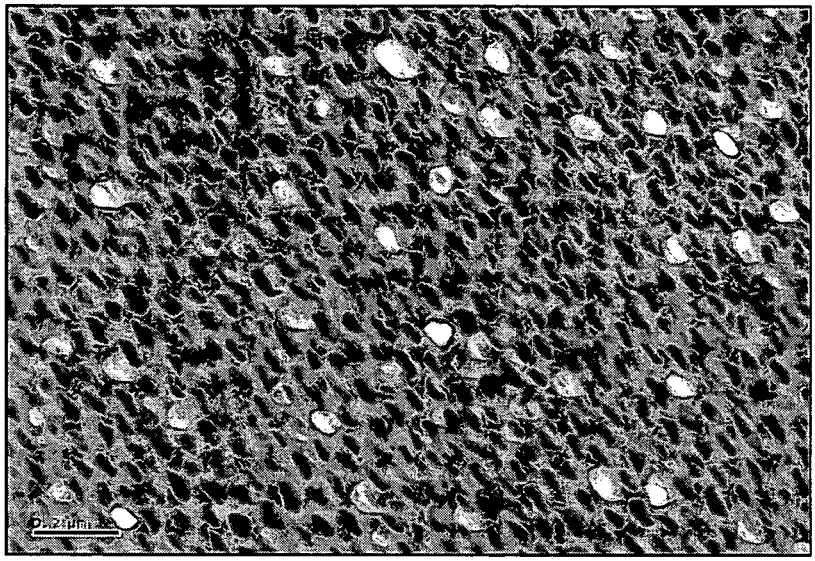
FIG. 3 demonstrates a TEM image of the PS-PDMS solution-cast film (the scale bar is 200 nm, the dark regions are PDMS blocks and the light regions are PS), according to embodiments of the invention.

The size exclusion chromatography (SEC) chromatogram of PS-PDMS is shown in FIG. 2. Peak 1 was identified as the copolymer with Mn=238000, polydispersity (pdi)=1.16, and accounts for 76.6% of the sample. Peak 2 was identified as residual PS homopolymer, Mn=114000, and accounts for the remaining 23.4%. Assuming that the Mn of the PS block in the copolymer is also 114 k, the composition of the copolymer is 114 k/124 k. The volume fraction of PS in the copolymer is 0.45. The volume fraction of PS in the mixture is 0.57 which exhibits a cylindrical morphology upon microphase separation in the bulk, as confirmed by the TEM image of the solution-cast film in FIG. 3 [Hasegawa, H.; Hashimoto, T. (1996). Self-assembly and morphology of block copolymer system. In *Comprehensive polymer science. Suppl.* 2, (ed. S. L. Aggarwal and S. Russo), p. 497. Pergamon, London].

Addition of a homopolymer to a near symmetric block copolymer causes swelling of the corresponding block chain, resulting in a curved interface instead of a flat interface to attain a favorable conformational entropy and a uniform packing density).

Electrospinning:

A 21 wt % solution of the above material was prepared by dissolution in a 3:1 mixture by weight of tetrahydrofuran (THF): dimethylformamide (DMF) (Aldrich). It formed a milky gel-like solution that was stable (no further solidification or precipitation takes place during storage) at room temperature. This solution was electrospun using a parallel plate setup as described previously [Shin, Y. M.; Hohman, M. M.; Brenner, M. P.; Rutledge, G. C. *Polymer* 2001, 42, 9955].

The electrical potential, solution flow rate, the protrusion of the spinnerette from the upper plate and the distance between the capillary tip and the collector were adjusted so that spinning was stable and dry nanofibers were obtained (Table 1).

TABLE 1

Operating parameters for the electrospinning process, according to embodiments of this invention.

| Flow rate | Spinnerette protrusion | Tip-to-collector distance | Voltage |
|---|---|---|---|
| 0.05 ml/min | 2 cm | 50 cm | 30 KV |

Scanning Electron Microscope (SEM)

A JEOL-6060SEM (JEOL Ltd, Japan) scanning electron microscope (SEM) was used to observe the general features of the fibers. The fibers were sputter-coated with a 2-3 nm layer of gold for imaging using a Desk II cold sputter/etch unit (Denton Vacuum LLC, NJ). The fiber diameters were determined using AnalySIS image processing software (Soft Imaging System Corp., Lakewood, USA).

Transmission Electron Microscope (TEM):

A JEOL JEM200CX (JEOL Ltd, Japan) transmission electron microscope (TEM) was used to observe internal features of the fibers. For lateral viewing the fibers were deposited directly onto a copper TEM grid. For axial viewing, the fibers were fixed in a glycol methacrylate based embedding system. (JB-4 Plus Embedding Kit, TED PELLA. INC.), and then sectioned into 100 nm slices using an ultramicrotome (RMC Scientific Corp. Tucson, Ariz.) with a diamond knife. No staining was necessary, as the intrinsic difference in electron density of PS block and PDMS block provided adequate contrast.

Differential Scanning Calorimeter (DSC):

The thermal transitions in the as-electrospun fibers of the block copolymer were characterized using a Q1000 modulated differential scanning calorimeter (DSC) (TA Instrument Inc., DE). The measurements were carried out under a nitrogen atmosphere and the sample was scanned for two cycles from −100 to 200° C. with a rate of 10° C. per minute.

X-Ray Photoelectron Spectrometer (XPS):

Surface chemistry of the fibers was characterized using a Kratos Axis Ultra X-ray photoelectron spectrometer (XPS) (Kratos Analytical, Manchester) with a monochromatized A1 Kα X-ray source. The XPS signals from the silicon and oxygen of the PDMS block were used to distinguish the two polymer blocks and to obtain the composition of the fiber surface.

Contact Angle and Contact Angle Hysteresis Measurements:

The contact angle of water on the electrospun mat was measured using a Contact Angle Meter G10 (Kruss, Germany). The final result was obtained by averaging at least 4 separate runs. Contact angle hysteresis was obtained by the sessile drop method [Lau, K. K. S.; Bico, J.; Teo, K. B. K.; Chhowalla, M.; Amaratunga, G. A. J.; Milne, W. I.; McKinley, G. H.; Gleason, K. K. *Nano Lett.,* 2003, 3, 1701]. To study the sliding behavior, water droplets were dripped on a fiber mat tilted at 17° and the motion of the droplets was observed using a video recorder.

Example 2

Characterization of the Electrospun Fibers

Figure 4:
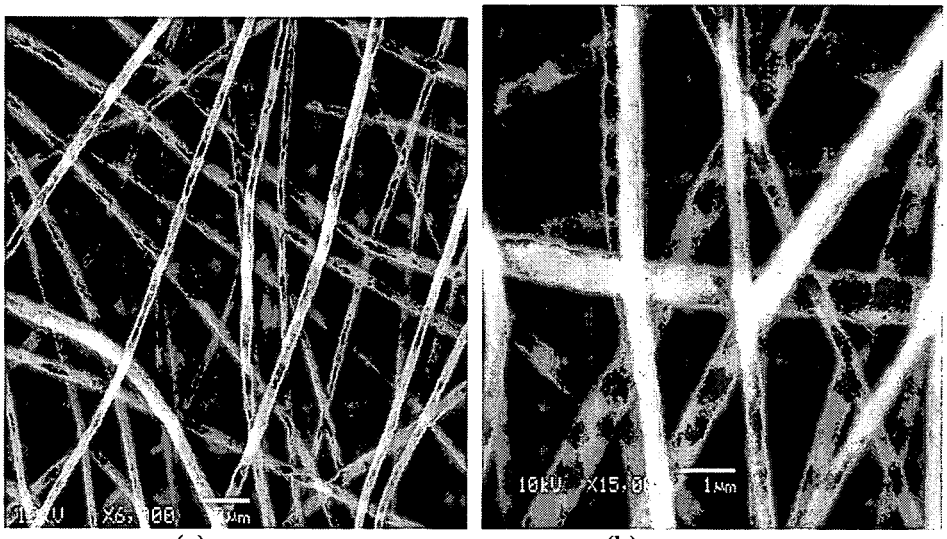
FIG. 4 demonstrates SEM images of electrospun PS-PDMS block copolymer fibers. (a) 6000× magnification (scale bar=2 microns); (b) 15,000× magnification (scale bar=1 micron), according to embodiments of the invention.

FIG. 4 shows typical SEM pictures of the fibers produced according to embodiments of the invention. The fiber diameter ranges from 150 to 400 nm. Besides the broad distribution of fiber diameter, "beading" on the fibers was also observed, but was generally minor, as demonstrated in FIG. 4. According to embodiments of the invention this "beading" might be due to the insufficiently fast stretching during the whipping and the heterogeneity of the microphase-separated solution.

Figure 5:
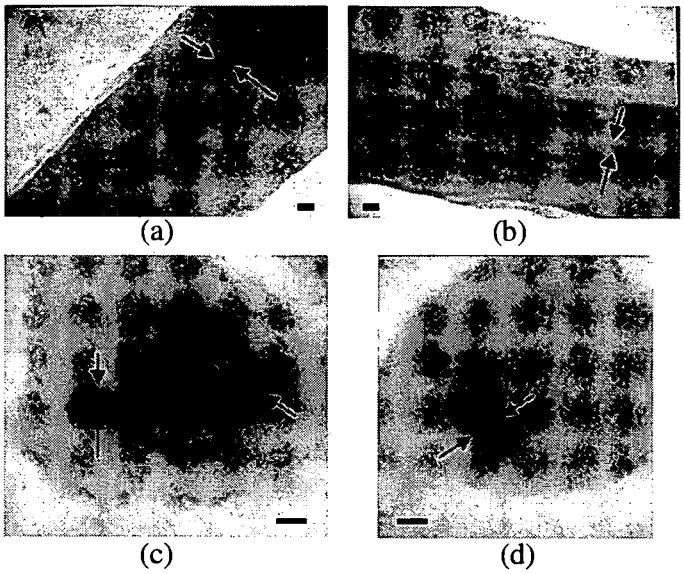
FIG. 5 demonstrates TEM images of single PS-PDMS fibers (a), (b) lateral views, (c), (d) axial views (all scale bars are 20 nm; the dark regions are PDMS blocks and the light regions are PS), according to embodiments of the invention.

FIG. 5 shows TEM images of the as-electrospun PS-PDMS fibers. The dark regions are associated with the higher electron density of the PDMS blocks. According to embodiments of the invention, judging from the longitudinal striations in FIGS. 5 (*a*) and (*b*) and the dark circular objects observed on the cross-section images in FIGS. 5 (*c*) and (*d*), the fibers appear to be comprised of PDMS cylinders with a diameter of about 20 nm dispersed in the PS matrix, consistent with the overall composition and the TEM images of the solution-cast film. According to further embodiments of the invention, due to the strong elongational flow in the electrospinning process, these cylinders appear to be well-aligned along the fiber axis.

The PS/PDMS diblocks are expected to be very strongly segregated due to the non-polar nature of the PDMS block. A rough estimate for the Flory interaction parameter $\chi$ is obtained by group contribution methods, $\chi=(100\ cm^3/mol)/RT)(\delta_{PS}-\delta_{PDMS})^2$, [Bristow, G. M.; Watson, W. F. *Trans. Faraday Soc.,* 1958, 54, 1731] where $\delta_{PS}=18.6\ (J/cm^3)^{1/2}$ and $\delta_{PDMS}=15.4\ (J/cm^3)^{1/2}$ are the Hildebrandt solubility parameters for PS and PDMS, respectively ['*Polymer Handbook*' (Eds J. Brandrup and E. H. Immergut). 3rd Edn, Wiley, New York, 1989, P. VII/557]. For a degree of polymerization N=2771, $\chi N=1130$, well in excess of $\chi N=10.5$ required for microphase separation in a symmetric diblock copolymer according to mean field theory [Leibler, L. Macromolecules, 1980, 13, 1602].

Figure 6:
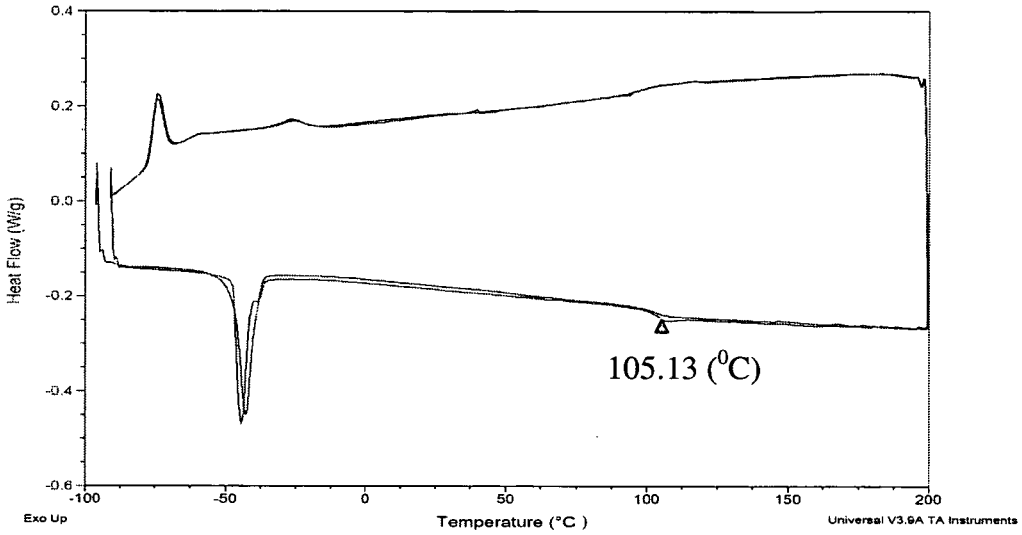
FIG. 6 demonstrates DSC curves for the phase separated PS-PDMS fibers (the top curves are the cooling runs in the first and second cycles and the bottom curves are the heating runs), according to embodiments of the invention.

Strong segregation of the PS and PDMS blocks is further evidenced by the glass transition temperature Tg of 105° C. exhibited in the DSC curve of FIG. 6. This transition temperature is characteristic of unblended PS. The glass transition of PDMS is −125° C. The rule of mixtures [Gordon, M.; Taylor, J. S. J. Appl Chem. 1952, 2, 493] would predict a glass transition of about −5° C. if the PS and PDMS were well mixed; no such peak is observed in FIG. 6. The endotherm around −40° C. during heating is attributed to the crystal melting point of PDMS, while the exotherm around −75° C. during cooling could be due to crystallization [Chu, J. H.; Rangarajan, P.; LaMonte Adams, J.; Register, R. A. *Polymer,* 1995, 36, 1569].

Figure 7:
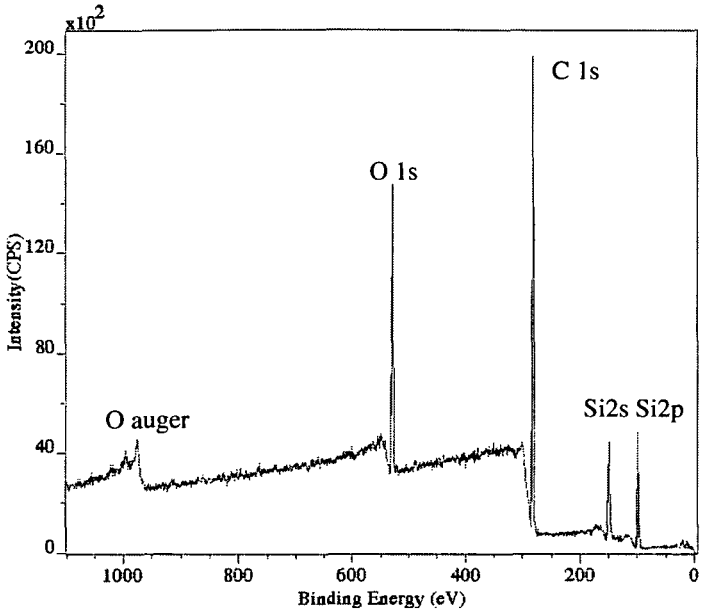
FIG. 7 demonstrates XPS data of the phase separated PS-PDMS fibers, according to embodiments of the invention.

From the material composition, the average atomic ratio of carbon to silicon is about 8.8. According to the XPS data shown in FIG. 7, the material layer within several nanometers of the fiber surface exhibits a carbon:silicon ratio of only 5.5, indicative of surface enrichment in the PDMS component. The surface tensions of PDMS and PS are 19.9 mN/m and 40.7 mN/m, respectively [Chan, C.-M. 'Polymer surface Modification and Characterization', 1st ed., (1994) Hanser Publishers, Munich]. Since the PDMS block has lower surface tension, it is more likely to segregate to the fiber surface. A similar enrichment of PDMS was reported for the films of PS/PS-b-PDMS blends [Lee, H.; Archer, L. A. Macromolecules 2001, 34, 4572]. Such a surface segregation of fluorine in electrospun fibers of poly(methyl methacylate-co-tetrahydroperfluorooctyl acrylate) was also observed [Deitzel, J. M.; Kosik, W.; McKnight, S. H.; Beck Tan, N. C.; Desimone, J. M.; Crette, S. *Polymer,* 2002, 43, 1025]. The reason that the fiber surface contained not just pure PDMS but also PS may be, in accordance with embodiments of this invention, the fact that solidification during the electrospinning takes place so fast (usually on the order of milliseconds) that PDMS blocks do not have enough time to segregate completely to the surface. The reason that the surface enrichment of PDMS is not apparent in the TEM axial images may be, in accordance with embodiments of this invention, that TEM only yields pictures of individual cross sections, while XPS averages results over the surfaces of all the fibers. The confinement and diameter of the fiber also has an effect on the microphase separation. For example, large fibers tend to contain more PDMS cylinders inside than the small ones. If the diameter is not an integer multiple of the preferred domain spacing, the domains must reorganize to accommodate the incommensuration.

Figure 8:
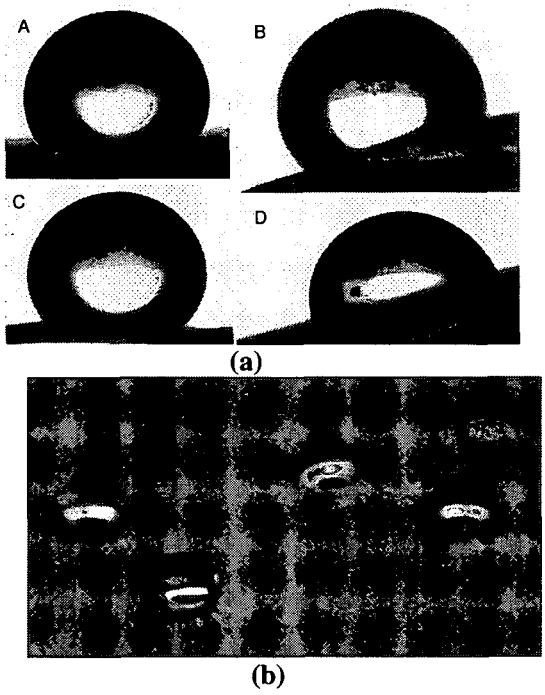
FIG. 8 demonstrates (a) A, C a water droplet on the horizontal surface of PS-PDMS fiber and pure PS fiber mat respectively; B, D the droplets were sliding on a 17°-tilted surface of PS-PDMS and pure PS fiber mat respectively, as recorded by a video at 25 frames per second; (b) a photograph showing super hydrophobicity of PS-PDMS fiber mat, according to embodiments of the invention.

The contact angle measurement and the sliding behavior of the water on the PS-PDMS electrospun mat are shown FIG. 8 (*a*) A and B. The contact angle was as high as 163° which is much larger than the contact angle of 112° for pure PDMS films [Gillmor S. D. et al., 2th Annual International IEEE-EMBS Special Topic Conference on Microtechnologies in medicine & Biology, 2002, Poster 225, 51].

The advancing and receding contact angles measured by the sessile drop method were 164° and 149°, respectively, giving a hysteresis of 15°. The wetting behavior of the PS-PDMS fiber mat were compared with that of a pure PS fiber mat with comparable fiber sizes (average diameter=300 nm) and pore size distribution (pore sizes ranging from 0.200 to 1.5 mm, as determined by Hg porosimetry, Quantachrome Instruments Poremaster 33). It was found that the PS fiber mat not only had a smaller contact angle (138°) but also showed a sliding behavior characterized by a much bigger contact area between the mat and the droplet than in the case of PS-PDMS block copolymer fiber, as shown on FIG. 8 (*a*) C and D. From these comparisons it can be concluded, in accordance with embodiments of this invention, that the superhydrophobicity observed for the PS-PDMS fiber mat is the combined result of both the roughness of the surface and the excess concentration of PDMS on the surface.

Example 3

Superhydrophobic Fiber Mats Prepared from Various Copolymers

Table 2 presents the composition and conditions for the preparation of additional electrospun superhydrophobic fibers. A number of additional fibers and mats comprising the same were produced using various copolymers, which yielded a water contact angle of above 150°.

| Sample No. | Copolymer | #Parts Copol | Resin | #Parts resin | % ttl solids | Solvent | Contact angle of mat |
|---|---|---|---|---|---|---|---|
| 1 | PS-DMS of Ex. #1 | 18 | MQ siloxane resin (Dow Corning 407) | 5 | 23 | 3:1 THF-DMF | 167.9 |
| 2 | PS-DMS of Ex. #1 | 15 | MQ siloxane resin (Dow Corning 407) | 10 | 25 | 3:1 THF-DMF | 168.9 |
| 3 | PS-DMS of Ex. #1 | 12 | MQ siloxane resin (Dow Corning 407) | 12 | 24 | 3:1 THF-DMF | 168.5 |
| 4 | PS-DMS of Ex. #1 | — | — | — | 12.95% weight solution | Chloroform | 170.5 |
| 5 | PS-PDMS MW: 153,000, PS Volume ratio of 0.813 | — | — | — | 9% weight solution | 4:1 chloroform-DMF mixture | 168 |
| 6 | Poly(dimethyl siloxane) Etherimide: 35–40% polydimethylsiloxane | — | — | — | 15% weight solution | Chloroform | 157.8 |

Some embodiments of mats were prepared, as described hereinabove, via electrospinning of a polystyrene-polydimethylsiloxane copolymer solution at a concentration of 12.95% in Chloroform, yielding a fibrous mat with a contact angle of 170.5 degrees.

Some embodiments of mats of this invention were prepared via electrospinning of the polystyrene-polydimethylsiloxane copolymer described herein, mixed in various ratios of copolymer to MQ siloxane resin (Dow Corning 407), dissolved in 3:1 THF-DMF solvent, electrospun to form a fibrous mat Some embodiments of mats of this invention were prepared via electrospinning of a polystyrene-polydimethylsiloxane copolymer having a total molecular weight of 153000 and a volume ratio of polystyrene=0.813, dissolved in a 4:1 chloroform-DMF solvent mixture. Fibrous mat with a water contact angle of 168° were obtained. Based on this example, copolymers with a volume percent of as little as 19 of silicone produce superhydrophobic fibrous mats.

Some embodiments of mats of this invention were prepared via electrospinning of a poly(dimethylsiloxane)etherimide copolymer with 35-40% polydimethylsiloxane electrospun from a 15 weight percent solution in chloroform to form a fibrous mat, which had a water contact angle of 157.8°.

These results indicate that a number of superhydrophobic fibers and mats can be prepared according to the methods of this invention.

What we claim is:

1. A non coated fiber comprising a copolymer, wherein a mat of said fibers exhibits a water contact angle of above 150° and water contact angle hysteresis of below 15°, wherein said copolymer comprises a component having a silicon structure and/or wherein said copolymer is fluorinated.

2. The fiber of claim 1, wherein the diameter of said fiber is between 1 nm-5 micron.

3. The fiber of claim 2, wherein said diameter is between 1 nm-500 nm.

4. The fiber of claim 1, wherein said water contact angle is above 160°.

5. The fiber of claim 1, wherein said fiber is an electrospun fiber.

6. The fiber of claim 1, wherein said fiber exhibits a microphase-separation.

7. The fiber of claim 1, wherein the surface energy of said component is less than about 40 mN/m.

8. The fiber of claim 7, wherein said component segregates to the surface of said fiber.

9. The fiber of claim 1, wherein said silicon structure is a resin, linear, branched, cross-linked, cross-linkable silicone structure or any combination thereof.

10. The fiber of claim 1, wherein said silicon structure is poly-dimethylsiloxane (PDMS).

11. The fiber of claim 1, wherein said copolymer comprises a polyisobutylene, polyolefin, polystyrene, polyacrylate, polyurethane, polyester, polyimide, polyetherimide, any derivative thereof or any combination thereof.

12. The fiber of claim 1, wherein said copolymer comprises a block, graft, star or random copolymer.

13. The fiber of claim 12, wherein said block copolymer comprises poly(styrene-co-dimethylsiloxane) (PS-PDMS).

14. The fiber of claim 12, wherein said fiber comprises poly-dimethylsiloxane (PDMS) blocks non-uniformly dispersed within a polystyrene (PS) matrix.

15. The fiber of claim 14, wherein said poly-dimethylsiloxane (PDMS) blocks segregate to the surface of said fibers.

16. The fiber of claim 12, wherein said block copolymer comprises poly(dimethylsiloxane-co-etherimide).

17. The fiber of claim 1, wherein said fiber exhibits surface roughness properties.

18. A composition or an article of manufacture comprising the fiber of claim 1.

19. A superhydrophobic mat of non coated fibers comprising a copolymer wherein said mat exhibits a water contact angle of above 150° and water contact angle hysteresis of below 15°, wherein said copolymer comprises a component having a silicon structure and/or wherein said copolymer is fluorinated.

20. The mat of claim 19, wherein said mat exhibits a water contact angle of above 160°.

21. The mat of claim 19, wherein said mat exhibits an isotropic nature of said contact angle, contact angle hysteresis or a combination thereof.

22. The mat of claim 19, wherein said mat exhibits a non-isotropic nature of said contact angle, contact angle hysteresis or a combination thereof.

23. The mat of claim 19, wherein the diameter of said fiber is between 1 nm-5 micron.

24. The mat of claim 23, wherein said diameter is between 1 nm-500 nm.

25. The mat of claim 19, wherein said fiber is an electrospun fiber.

26. The mat of claim 19, wherein said fiber exhibits a microphase-separation.

27. The mat of claim 19, wherein the surface energy of said component is less than about 40 mN/m.

28. The mat of claim 27, wherein said component segregates to the surface of said fiber.

29. The mat of claim 19, wherein said silicon structure is a resin, linear, branched, cross-linked, cross-linkable silicone structure or any combination thereof.

30. The mat of claim 19, wherein said silicon structure is poly-dimethylsiloxane (PDMS).

31. The mat of claim 19, wherein said copolymer comprises a polyisobutylene, polyolefin, polystyrene, polyacrylate, polyurethane, polyester, polyamide, polyetherimide, any derivative thereof or any combination thereof.

32. The mat of claim 19, wherein said copolymer comprises a block, graft, star or random copolymer.

33. The mat of claim 32, wherein said block copolymer comprises poly(styrene-co-dimethylsiloxane) (PS-PDMS).

34. The mat of claim 32, wherein said fiber comprises poly-dimethylsiloxane (PDMS) blocks non-uniformly dispersed within a polystyrene (PS) matrix.

35. The mat of claim 34, wherein said poly-dimethylsiloxane (PDMS) blocks segregate to the surface of said fibers.

36. The mat of claim 32, wherein said block copolymer comprises poly(dimethylsiloxane-co-etherimide).

37. The mat of claim 19, wherein said mat exhibits surface roughness properties.

38. The mat of claim 19, wherein said mat exhibits pore size of between 0.1-100 micron.

39. An article of manufacture comprising the mat of claim 19.

40. The article of manufacture of claim 39, wherein said article of manufacture is a waterproof, water resistant or water draining substance.

41. The article of manufacture of claim 39, wherein said article of manufacture is a self-cleaning substance.

42. The article of manufacture of claim 39, wherein said article of manufacture is a coating substance.

43. The article of manufacture of claim 42, wherein said coating reduces drag.

44. The article of manufacture of any one of claims 39-43, wherein said article of manufacture is a fabric.

45. The article of manufacture of claim 44, wherein said fabric is a breathable fabric.

46. The article of manufacture of claim 44, wherein said fabric has a filtration functionality.

47. The article of manufacture of claim 44, wherein said fabric has an absorptive functionality.

48. The article of manufacture of claim 44, wherein said fabric is a non-woven fabric.

49. The article of manufacture of claim 44, wherein said fabric is a waterproof or water resistant fabric.

50. The article of manufacture of any one of claim 39, wherein said article of manufacture is a drug delivery system.

51. The article of manufacture of any one of claim 39, wherein said article of manufacture is a bandage or patch.

52. The article of manufacture of claim 51, wherein said bandage or patch comprise a drug.

53. A method for preparing a non coated fiber or fibers, the method comprising the step of electrospinning a solution comprising a copolymer, wherein said copolymer comprises a component having a silicon structure and/or wherein said copolymer is fluorinated, wherein a mat of said fibers exhibits a water contact angle of above 150° and water contact angle hysteresis of below 15°.

54. The method of claim 53, wherein the diameter of said fiber is between 1 nm-5 micron.

55. The method of claim 53, wherein said diameter is between 1 nm-500 nm.

56. The method of claim 53, wherein said water contact angle is above 160°.

57. The method of claim 53, wherein said fiber exhibits a microphase-separation.

58. The method of claim 53, wherein said component segregates to the surface of said fibers.

59. The method of claim 53, wherein said silicon structure is a resin, linear, branched, cross-linked, cross-linkable silicone structure or any combination thereof.

60. The method of claim 53, wherein said silicon structure is poly-dimethylsiloxane (PDMS).

61. The method of claim 53, wherein said copolymer comprises a polyisobutylene, polyolefin, polystyrene, polyacrylate, polyurethane, polyester, polyamide, any derivative thereof or any combination thereof.

62. The method of claim 53, wherein said copolymer comprises a block, graft, star or random copolymer.

63. The method of claim 62, wherein said block copolymer comprises poly(styrene-co-dimethylsiloxane) (PS-PDMS).

64. The method of claim 63, wherein the concentration of said poly(styrene-co-dimethylsiloxane) (PS-PDMS) in said solution is 21%.

65. The method of claim 53, wherein said fiber comprises poly-dimethylsiloxane (PDMS) blocks non-uniformly dispersed within a polystyrene (PS) matrix.

66. The method of claim 65, wherein said poly-dimethylsiloxane (PDMS) blocks segregate to the surface of said fibers.

67. The method of claim 53, wherein said fiber exhibits surface roughness properties.

68. The method of claim 53, wherein said solution further comprises tetrahydrofuran, diethylformamide, chloroform or a combination thereof.

69. The method of claim 53, wherein said solution further comprises tetrahydrofuran and diethylformamide in a ratio of 3:1.

70. The method of claim 53, wherein said solution further comprises chloroform and diethylformamide in a ratio of 4:1.

71. The method of claim 53, further comprising the step of producing a superhydrophobic mat comprising said fibers.

72. The method of claim 71, wherein said mat exhibits surface roughness properties.

73. The mat of claim 71, wherein said mat exhibits pore sizes of between 0.1-100 micron.

74. The method of claim 71, wherein said mat exhibits a non-isotropic nature of said contact angle, contact angle hysteresis or a combination thereof.

* * * * *